US006698037B2

(12) United States Patent
Lippé

(10) Patent No.: US 6,698,037 B2
(45) Date of Patent: Mar. 2, 2004

(54) SHOWER STRUCTURE AND METHOD FOR ASSEMBLING THE SAME

(75) Inventor: Michel Lippé , Mont St-Hilaire (CA)

(73) Assignee: Investhor 2000 Inc., Quebec (CA)

( * ) Notice: Subject to any disclaimer, the term of this patent is extended or adjusted under 35 U.S.C. 154(b) by 0 days.

(21) Appl. No.: 10/339,397

(22) Filed: Jan. 10, 2003

(65) Prior Publication Data

US 2003/0135921 A1 Jul. 24, 2003

(30) Foreign Application Priority Data

Jan. 11, 2002 (CA) ..... 2366049

(51) Int. Cl.[7] ..... A47K 3/22; A47K 3/34; A47K 3/36

(52) U.S. Cl. ..... 4/612; 4/614; 52/79.4; 52/264; 52/265

(58) Field of Search ..... 4/596, 612–614; 52/79.4, 79.7, 79.9, 264, 265

(56) References Cited

U.S. PATENT DOCUMENTS 1,933,857 A * 11/1933 Jones ..... 4/614
2,065,531 A * 12/1936 Kerr ..... 4/612
2,294,914 A * 9/1942 Kerr ..... 4/612
2,389,724 A * 11/1945 Falco ..... 52/264
4,720,876 A * 1/1988 Tomei et al. ..... 4/614
4,993,201 A * 2/1991 Bunyard ..... 4/614

* cited by examiner

*Primary Examiner*—Tuan N. Nguyen
(74) *Attorney, Agent, or Firm*—Baker & Hostetler LLP

(57) ABSTRACT

The shower structure comprises a base for containing water, two panels and a two-part elongated joint. The base comprises a doorstep, a base edge and a bottom. The base edge has an inner portion lower than upper surface of the doorstep. Each panel has a first panel edge provided with an inner portion for contact with the inner portion of the base edge for fitting the base and the panel in a watertight manner, a second panel edge also provided with an inner portion. The joint includes an outer part having, along its length, two distal joint edges. Each joint edge is adapted for connection to the inner portion of the second panel edge for fitting the panel and the outer part of the joint together. An inner part of the joint is connected to the outer part for sealing the base and panels together in a watertight manner.

5 Claims, 27 Drawing Sheets

SHOWER STRUCTURE AND METHOD FOR ASSEMBLING THE SAME

FIELD OF THE INVENTION

The present invention relates to shower structures.

DISCUSSION OF PRIOR ART

Shower structures actually used are composed of interconnected panels and a base for containing water. The panels are connected to the base at a higher level then the doorstep of the base. Thus, different products such as, glue, silicone or any other type of sealer must be used for sealing the panels to the base in a watertight manner to avoid water spillage outside the base. Moreover, these shower structures are not soundproof.

SUMMARY OF THE INVENTION

An object of the present invention is to provide a shower structure easily and rapidly assembled.

According to the present invention, there is a shower structure, comprising: a base comprising a doorstep, a base edge and a bottom surrounded by the base edge and the doorstep, both the base edge and the doorstep being upper than the bottom for containing water, said base case having an inner portion lower than upper surface of the doorstep; at least two panels, each having a first panel edge provided with an inner portion for contact with the inner portion of the base edge for fitting the base and the panel in a watertight manner, a second panel edge also provided with an inner portion, and securing means for securing the panels to adjacent walls; and a two-part elongated joint including an outer part having, along its length, two distal joint edges, each joint edge adapted for connection to the inner portion of the second panel edge for fitting the panel and the outer part of the joint together, an inner pan connectable to the outer part for sealing the base and panels together in a watertight manner, securing means for securing the outer part of the joint to said adjacent walls, and connecting means for connecting the two parts of the joint together.

The shower structure according to the present invention is that it is easy and rapidly assembled. Effectively, the installation of this shower structure compared to common shower structure eliminates a lot of assembly steps. The assembly does not require any special tools.

According to the present invention, there is also provided a method for assembling a shower structure, comprising the following steps: fixing a base to a floor, the base comprising a doorstep, a base edge and a bottom surrounded by the base edge and the doorstep, both the base edge and the doorstep being upper than the bottom for containing water, said base edge having an inner portion lower than upper surface of the doorstep; fixing an outer part of a joint in relation to the base to at least one adjacent wall, the outer part having, along its length, two distal joint edges; securing the outer part of the joint to said adjacent walls; connecting two panels to the base on both sides of the joint, each of the panels having a first panel edge provided with an inner portion for contact with the inner portion of the base edge for fitting the base and the panel in a watertight manner, a second panel edge also provided with an inner portion, each joint edge adapted for connecting with the inner portion of the second panel edge for fitting the panel and the outer part of the joint together; securing the panels to adjacent walls; and connecting an inner part of the joint to the outer part of the joint for sealing the base and panels together in a watertight manner.

BRIEF DESCRIPTION OF THE DRAWINGS

These and other objects and advantages of die invention will become apparent upon reading the detailed description and upon referring to the drawings in which.

DETAILED DESCRIPTION OF PREFERRED EMBODIMENTS OF THE INVENTION

Figure 1:
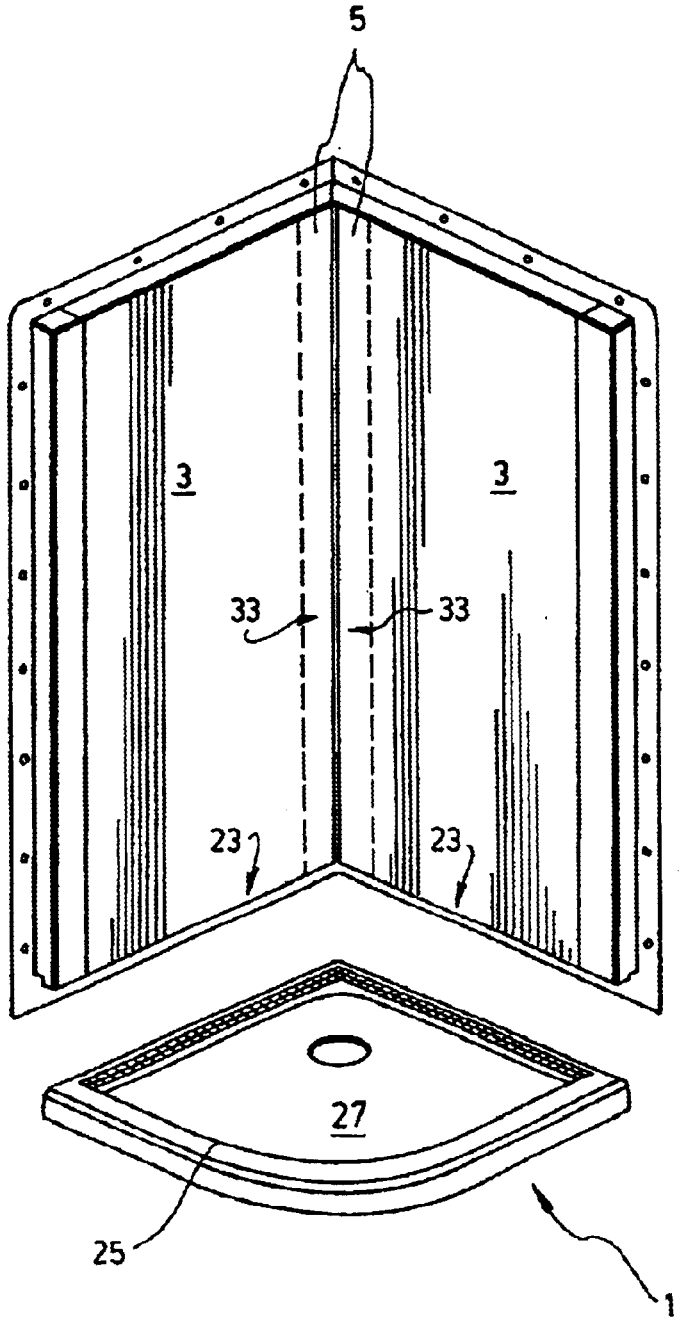
FIG. 1 is a perspective view of a shower structure according to a preferred embodiment of the invention.
Figure 2:
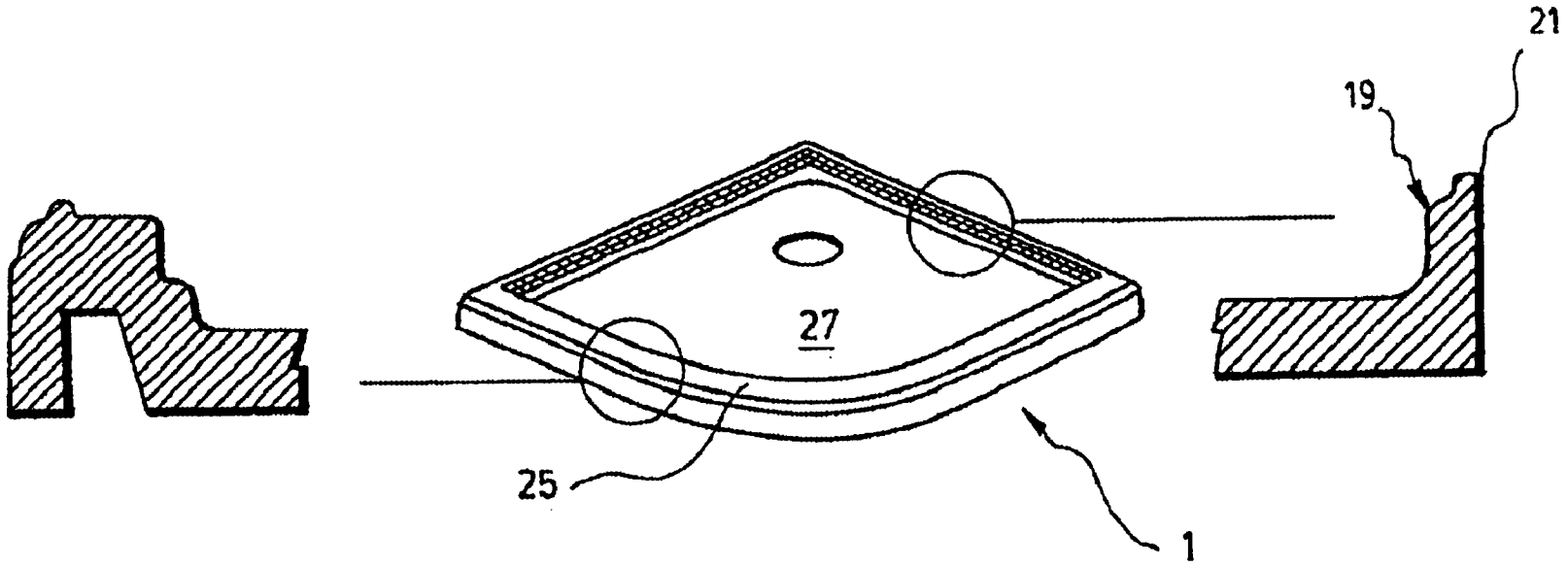
FIG. 2 is a perspective view of the base shown in FIG. 1.
Figure 3:
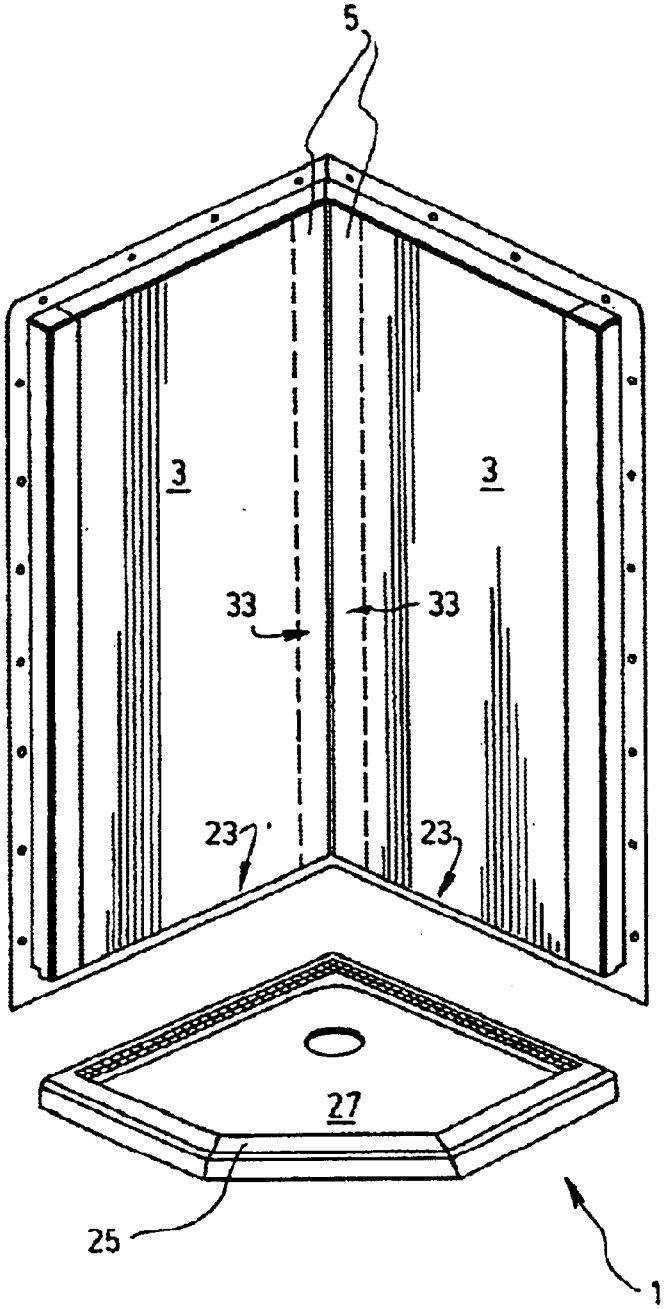
FIG. 3 is a perspective view of a shower structure according to another preferred embodiment of the invention.
Figure 4:
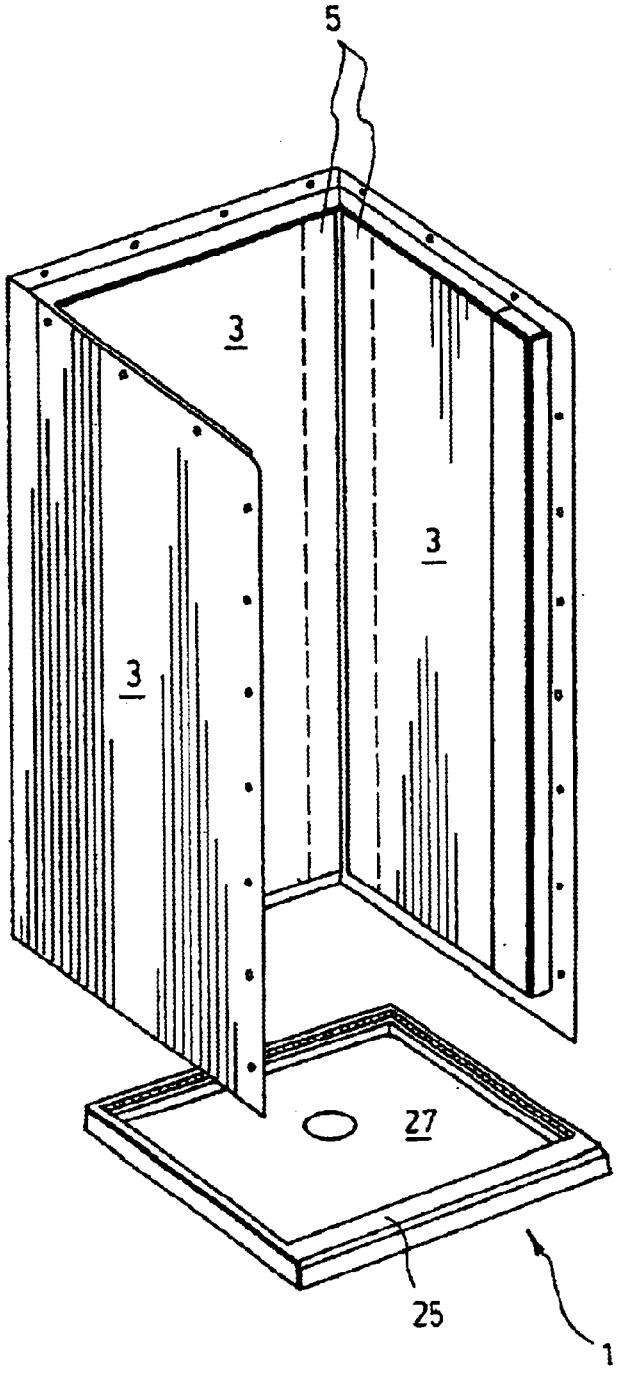
FIG. 4 is a perspective view of a shower structure according to another preferred embodiment of the invention.
Figure 5:
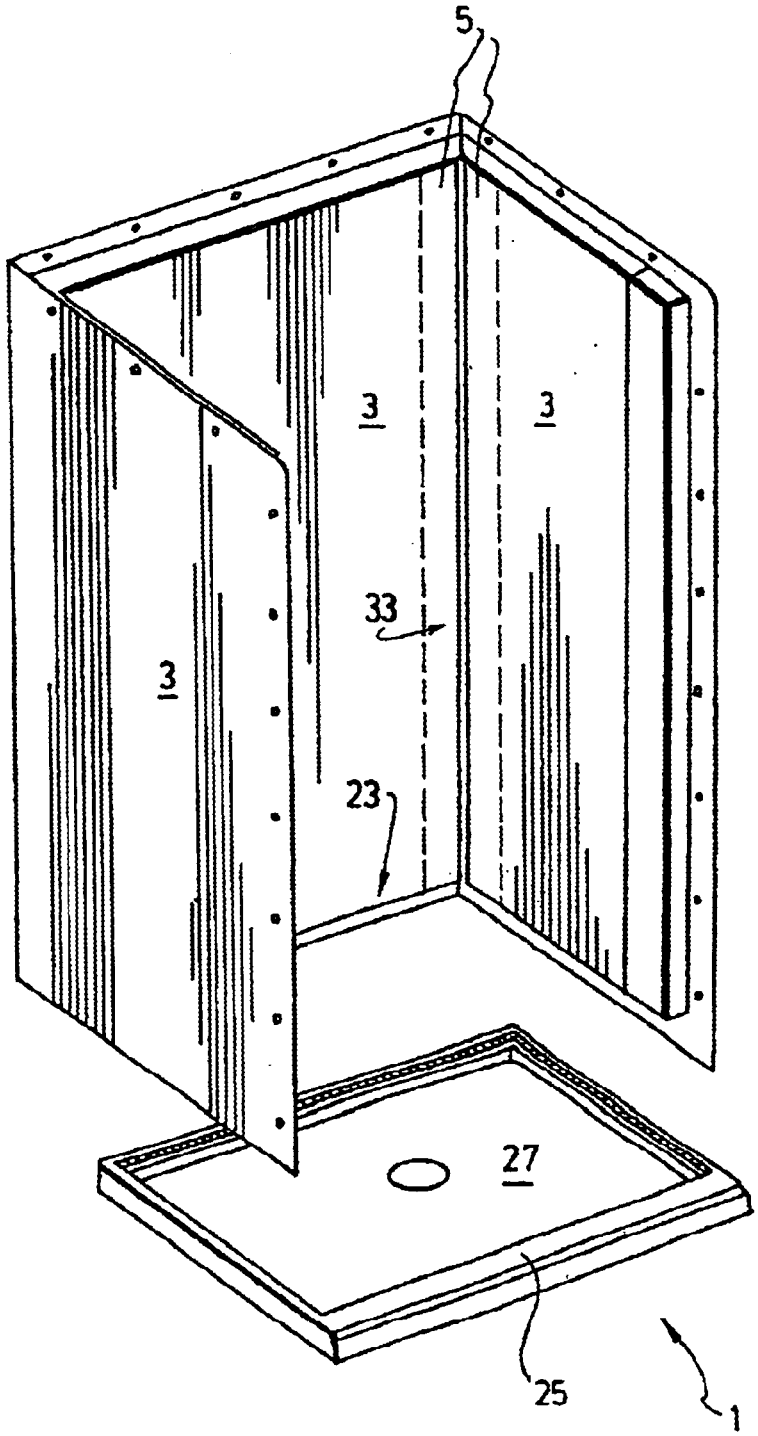
FIG. 5 is a perspective view of a shower structure according to another preferred embodiment of the invention.
Figure 6:
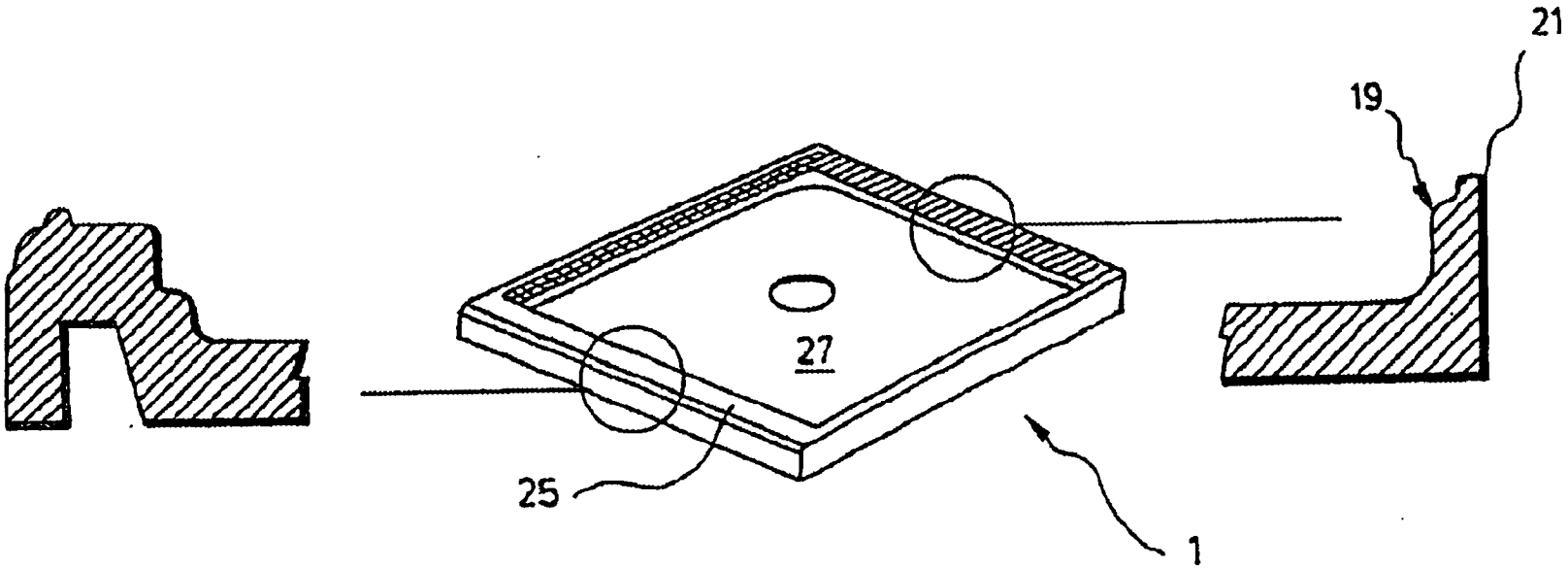
FIG. 6 is a perspective view of the base shown in FIGS. 4 and 5.
Figure 7:
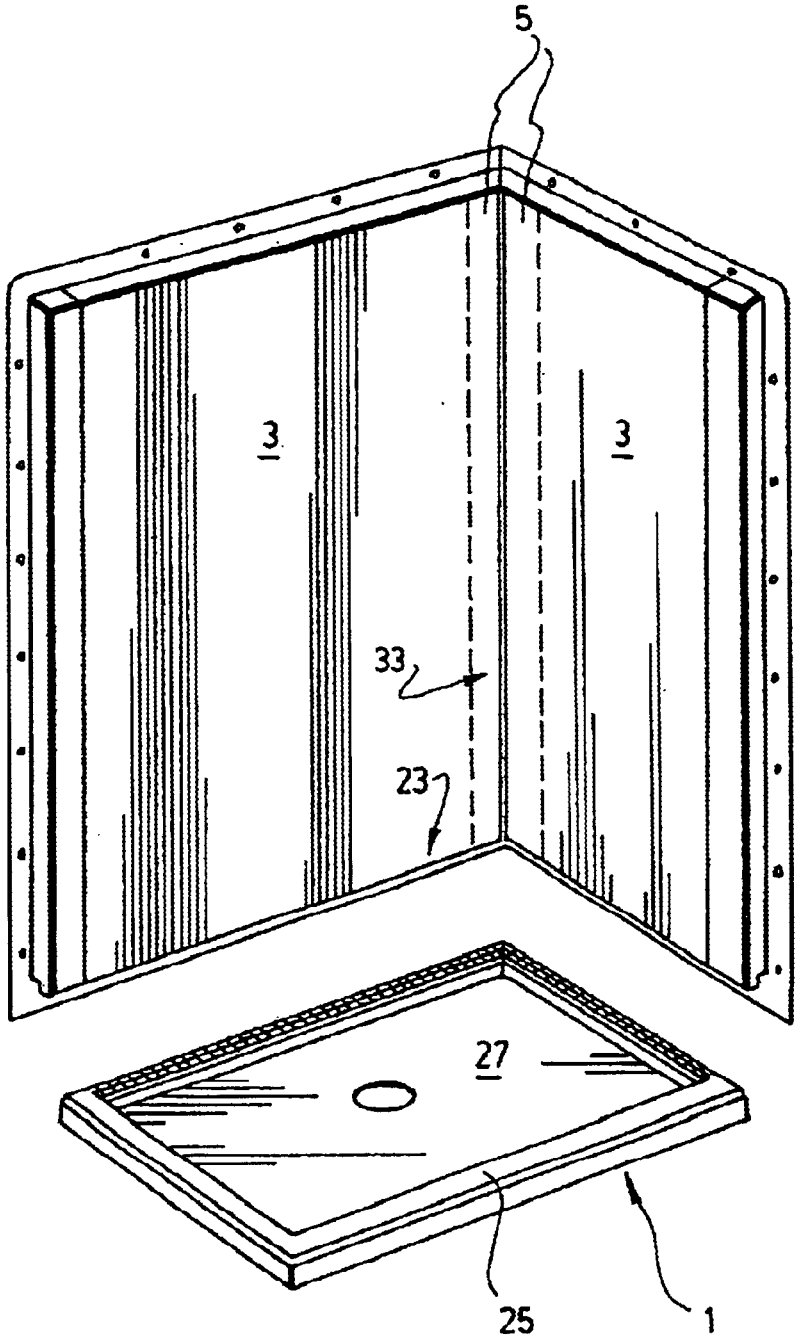
FIG. 7 is a perspective view of a shower structure according to another preferred embodiment of the invention.
Figure 8:
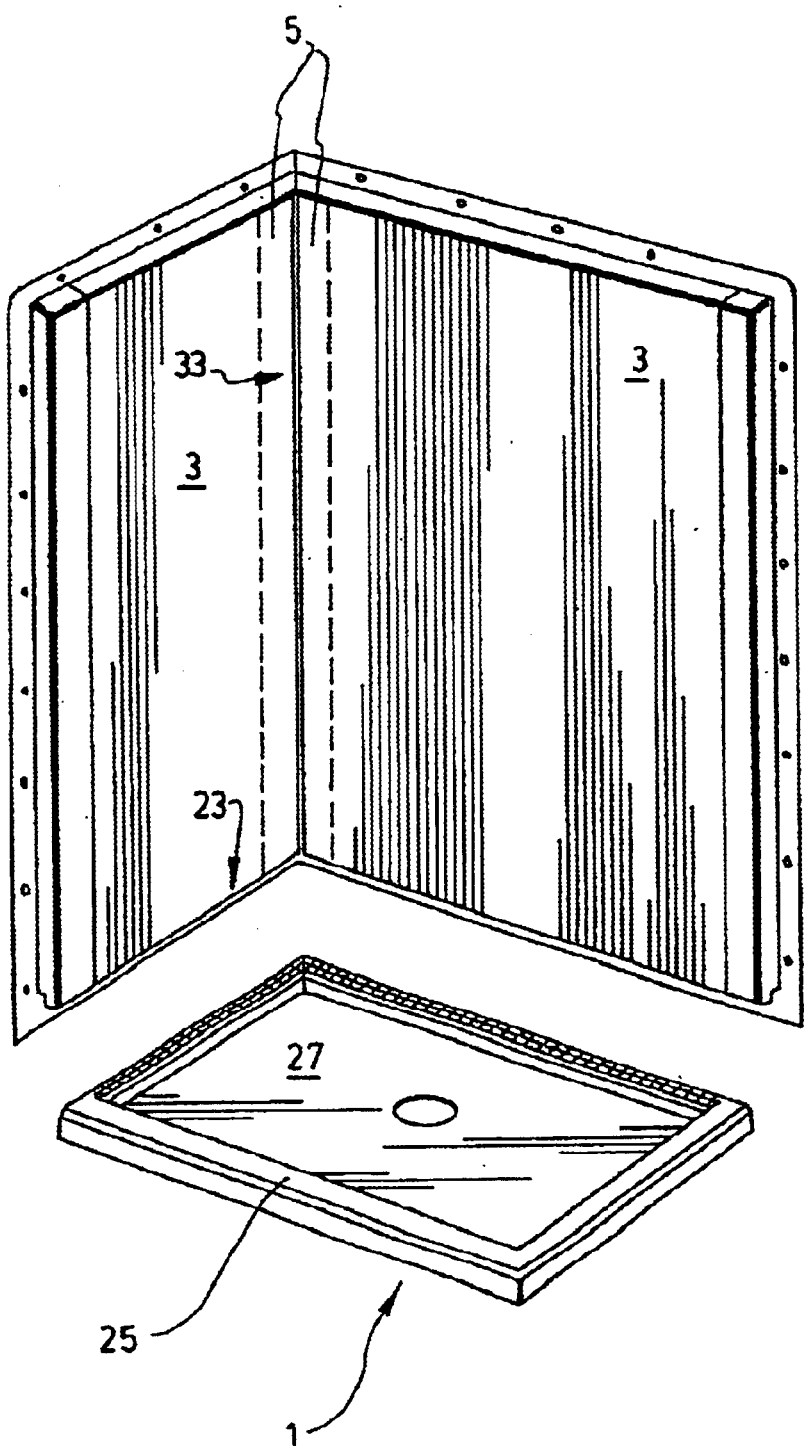
FIG. 8 is a perspective view of a shower structure according to another preferred embodiment of the invention.
Figure 9:
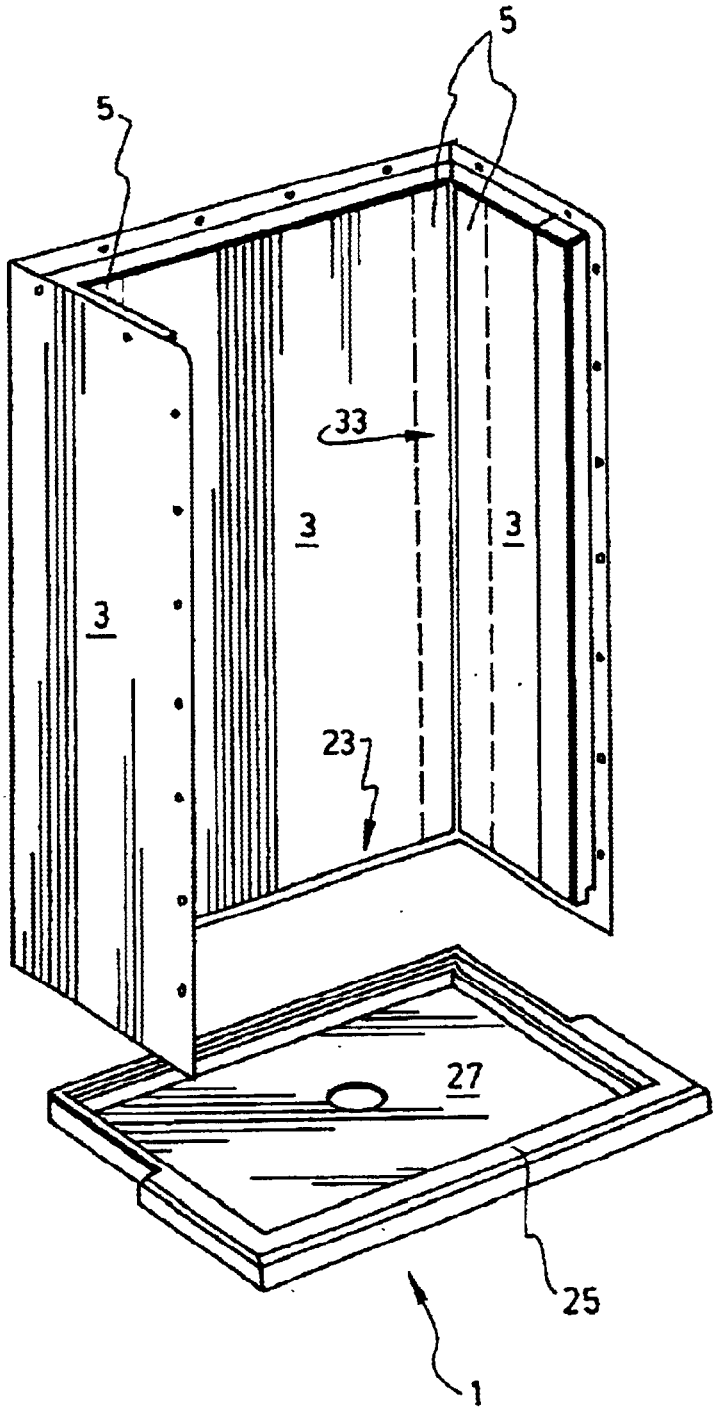
FIG. 9 is a perspective view of a shower structure according to another preferred embodiment of the invention.
Figure 10:
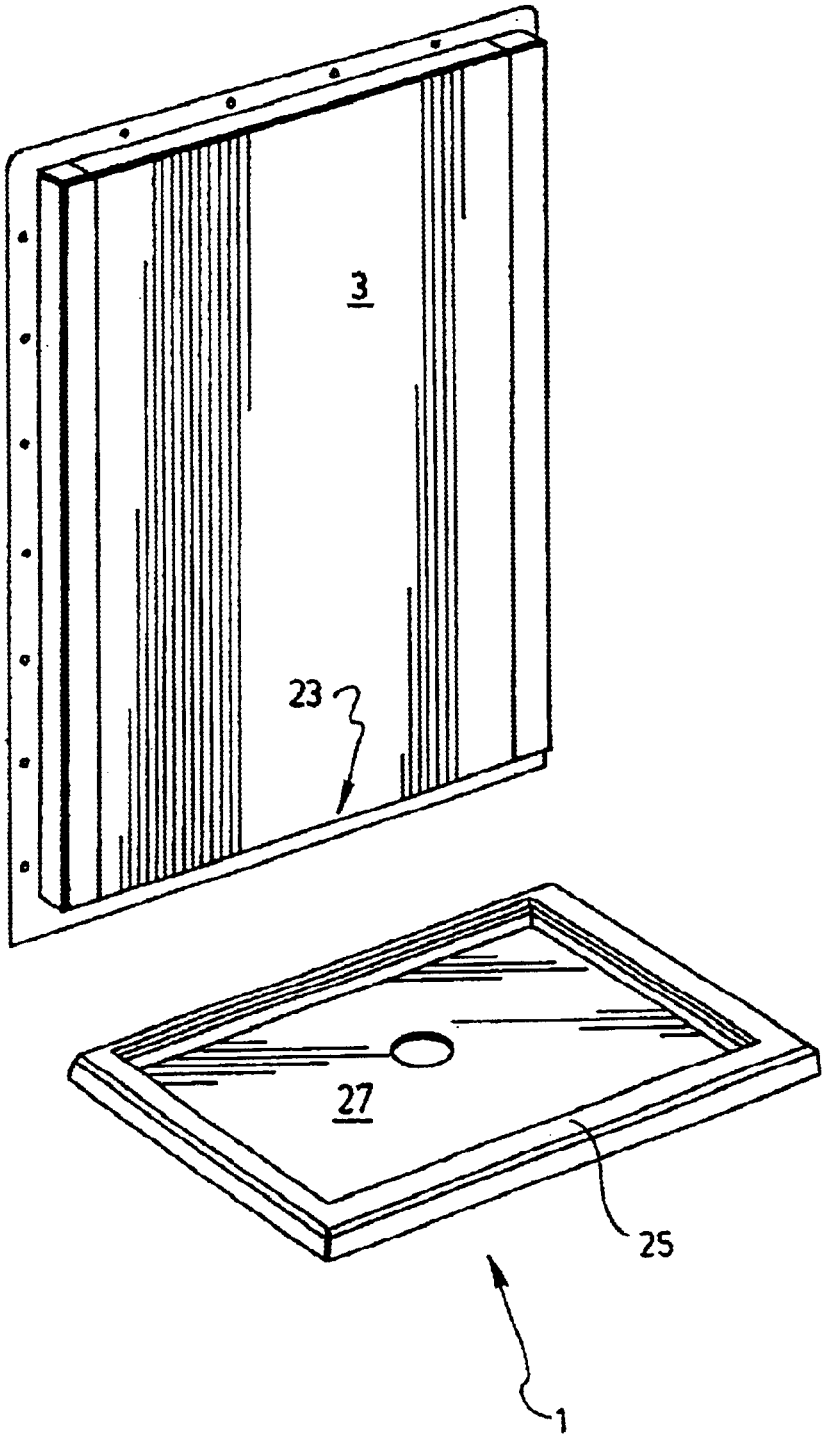
FIG. 10 is a perspective view of a shower structure according to another preferred embodiment of the invention.
Figure 11:
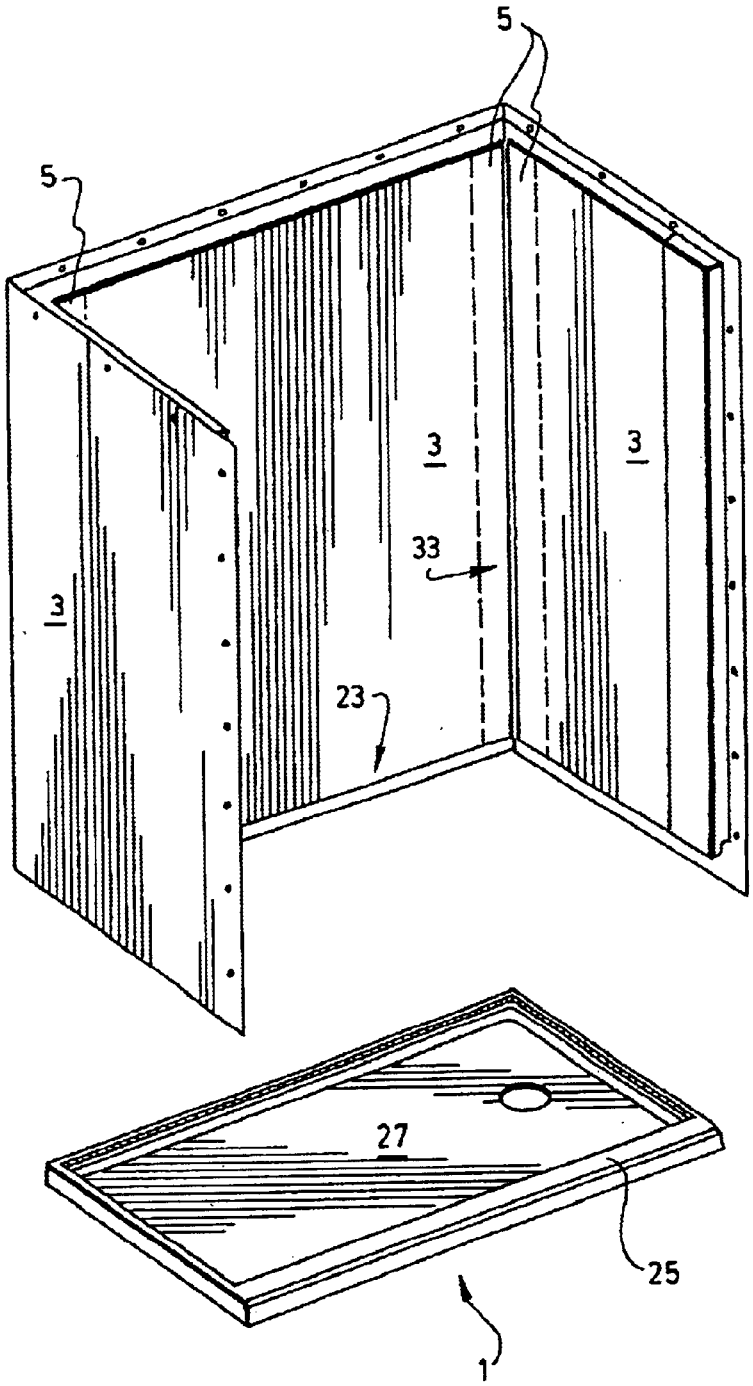
FIG. 11 is a perspective view of a shower structure according to another preferred embodiment of the invention
Figure 12:
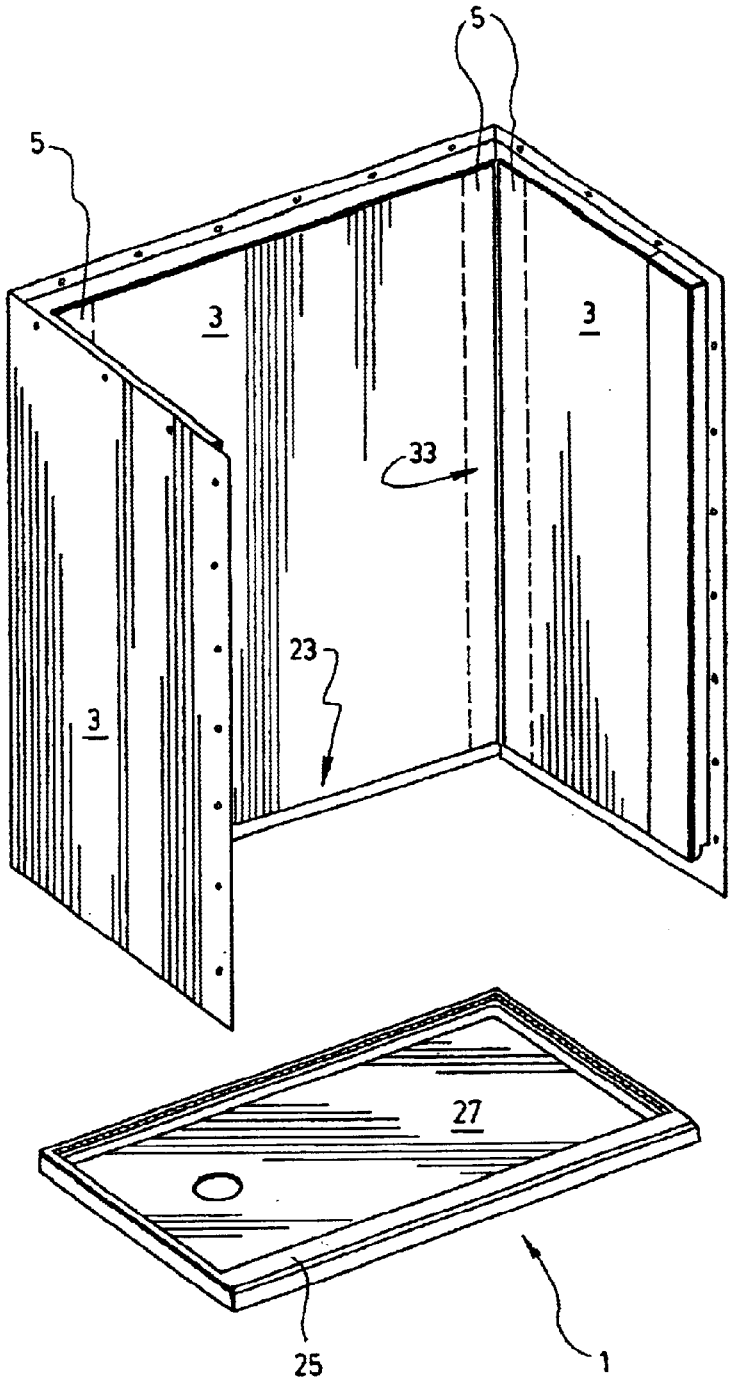
FIG. 12 is a perspective view of a shower structure according to another preferred embodiment of the invention.
Figure 13:
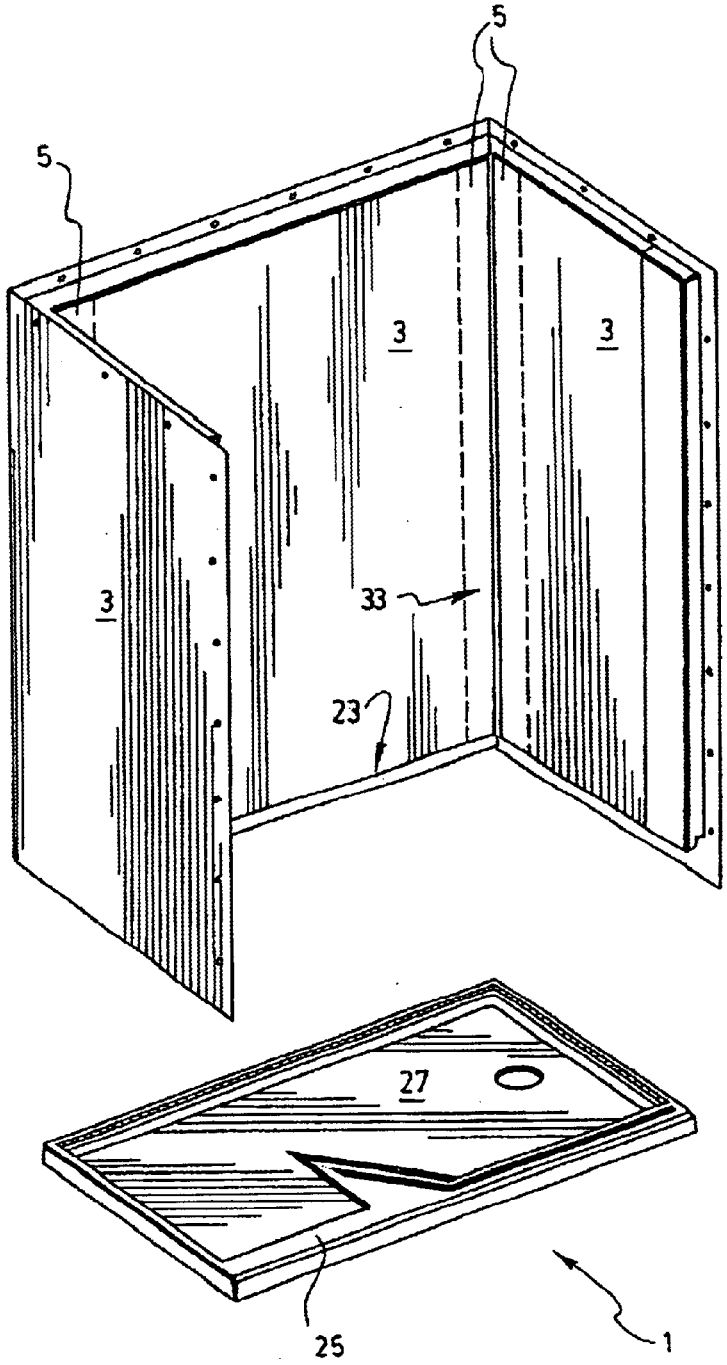
FIG. 13 is a perspective view of a shower structure according to another preferred embodiment of the invention
Figure 14:
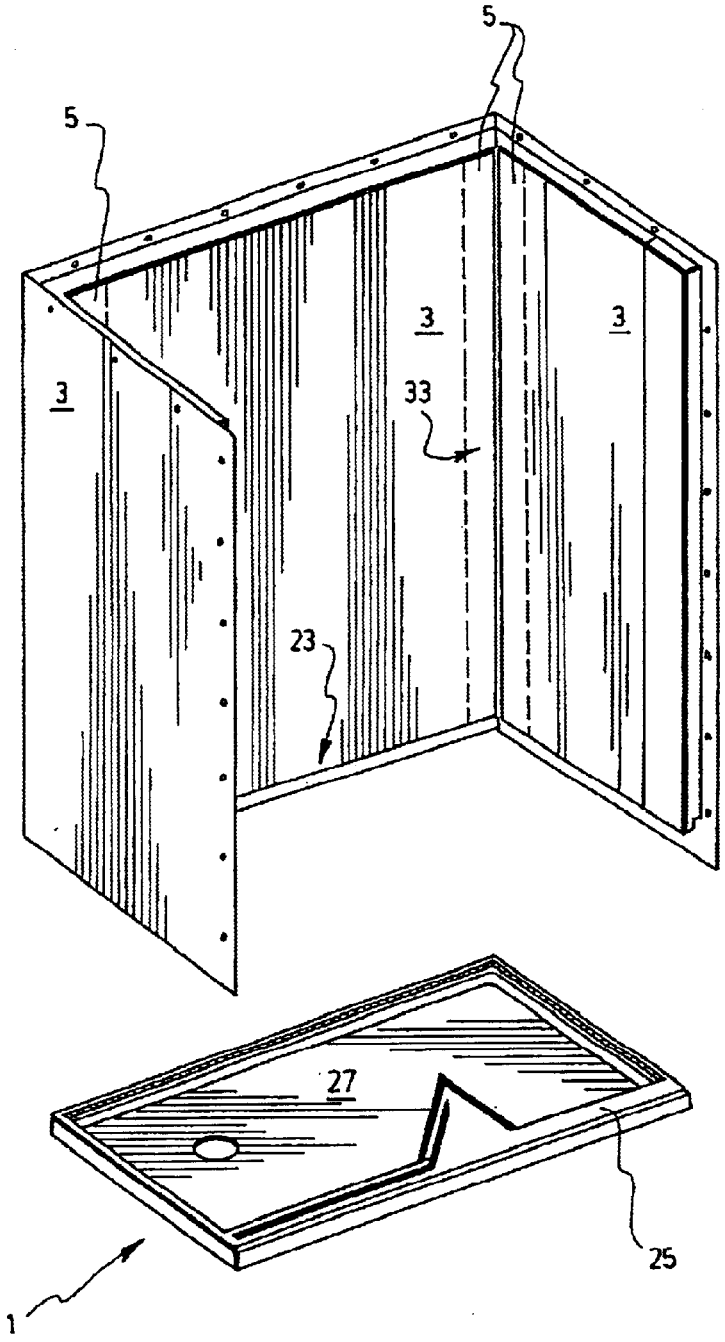
FIG. 14 is a perspective view of a shower structure according to another preferred embodiment of the invention.
Figure 15:
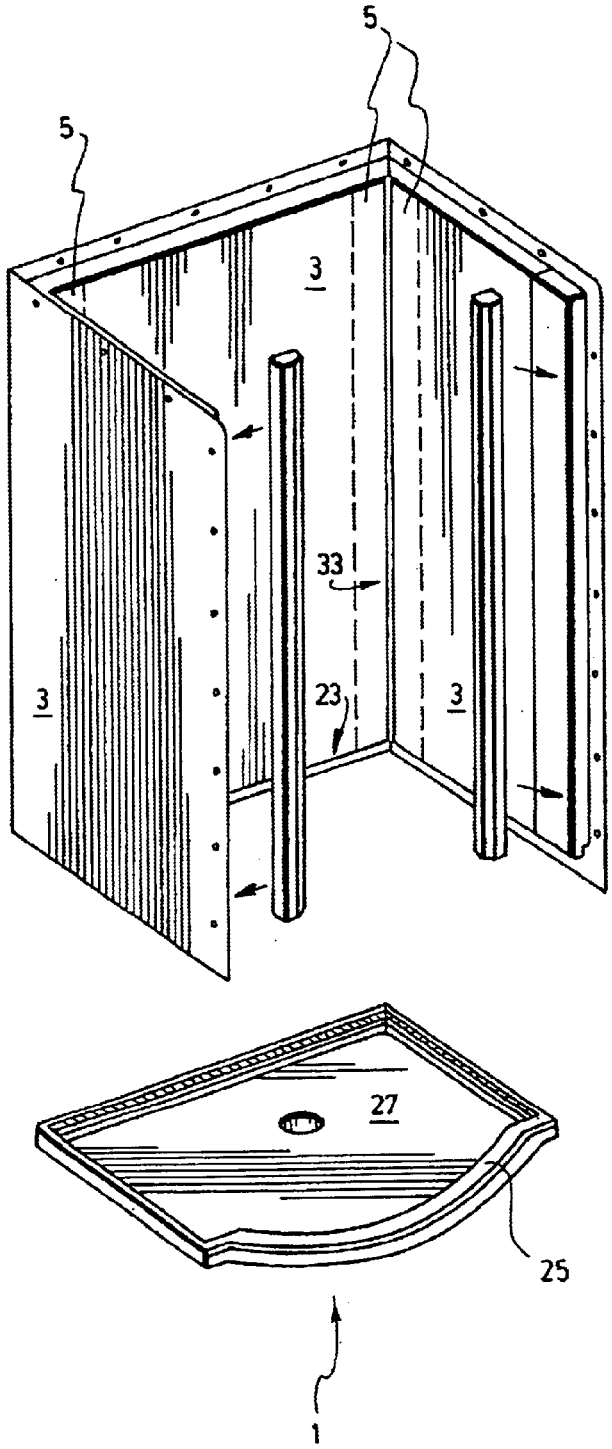
FIG. 15 is a perspective view of a shower structure according to another preferred embodiment of the invention
Figure 16:
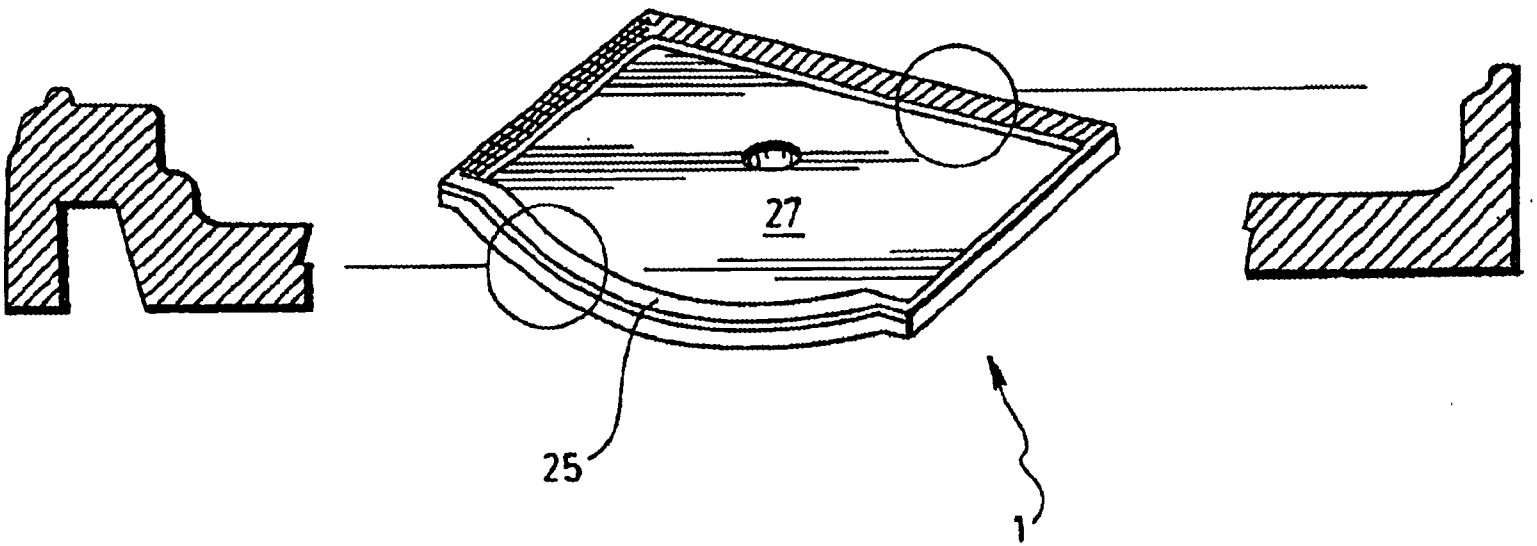
FIG. 16 is a perspective view of the base showed in FIG. 15.

A detailed description of preferred embodiments will be given herein below with reference to the following drawings, in which like numbers refer to like elements.

Referring now to FIGS. 1 to 16 and 18 to 20, there is shown a shower structure, comprising a base 1 comprising a doorstep 25, a base edge 21 and a bottom 27 surrounded by the base edge 21 and the doorstep 25. The shape and dimensions of the base can vary depending on the user needs. The bottom 27 has an opening for draining water. Both the base edge 21 and the doorstep 25 are upper than the bottom 27 for containing water. The base edge 21 has an inner portion 19 lower than upper surface of the doorstep 25.

The shower structure also comprises at least two panels 3. The dimensions of the panels 3 can vary depending on the user needs. Each panel 3 has a first panel edge provided with an inner portion 23 for contact with the inner portion 19 of the base edge 21 for fitting the base 1 and the panel 3 in a watertight manner. Each panel 3 also has a second panel edge also provided with an inner portion 33, and securing device for securing the panels 3 to adjacent walls.

Figure 23:
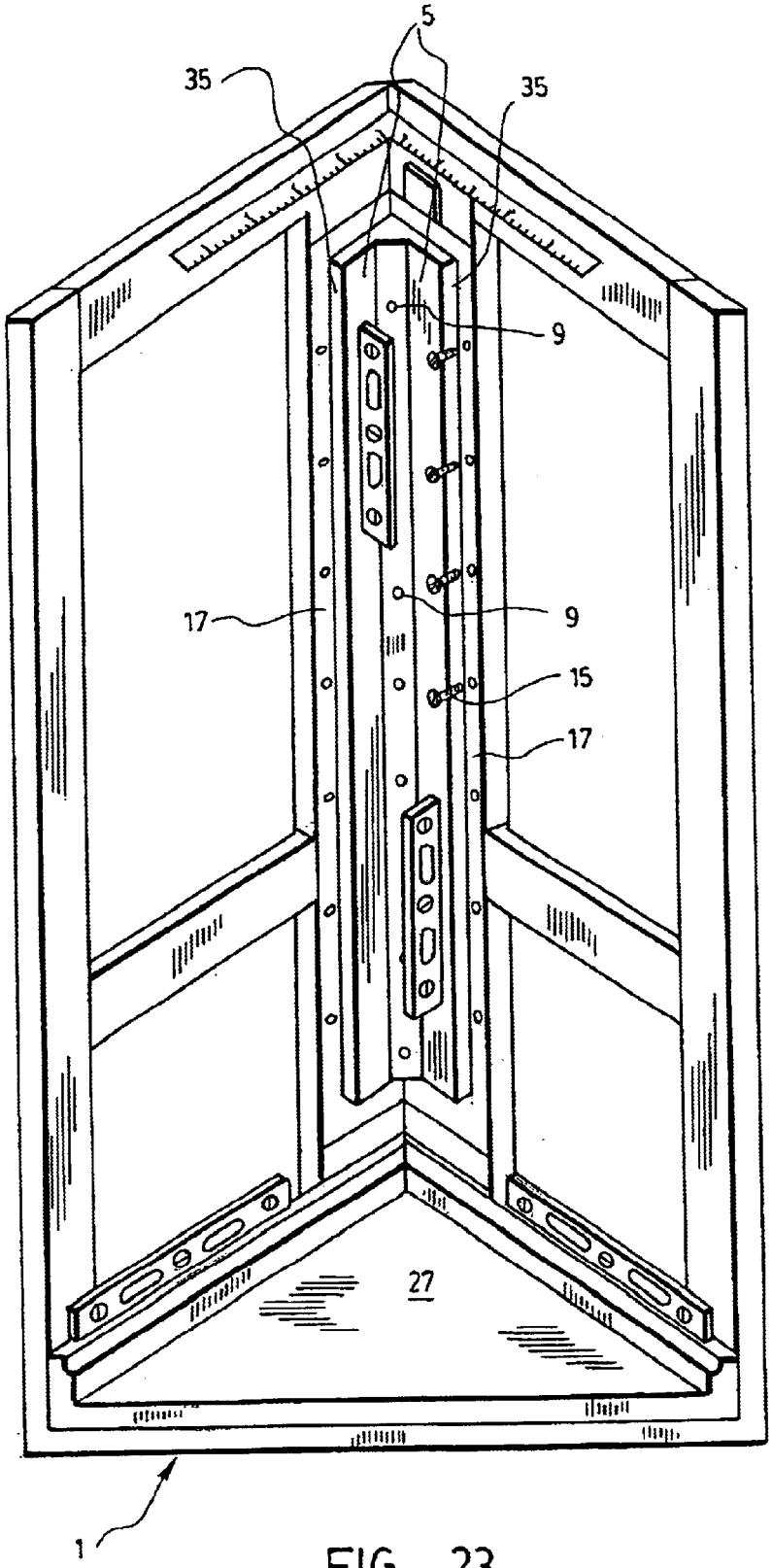
FIG. 23 is a partial perspective view of the outer part of the joint in rotation to the base.
Figure 24:
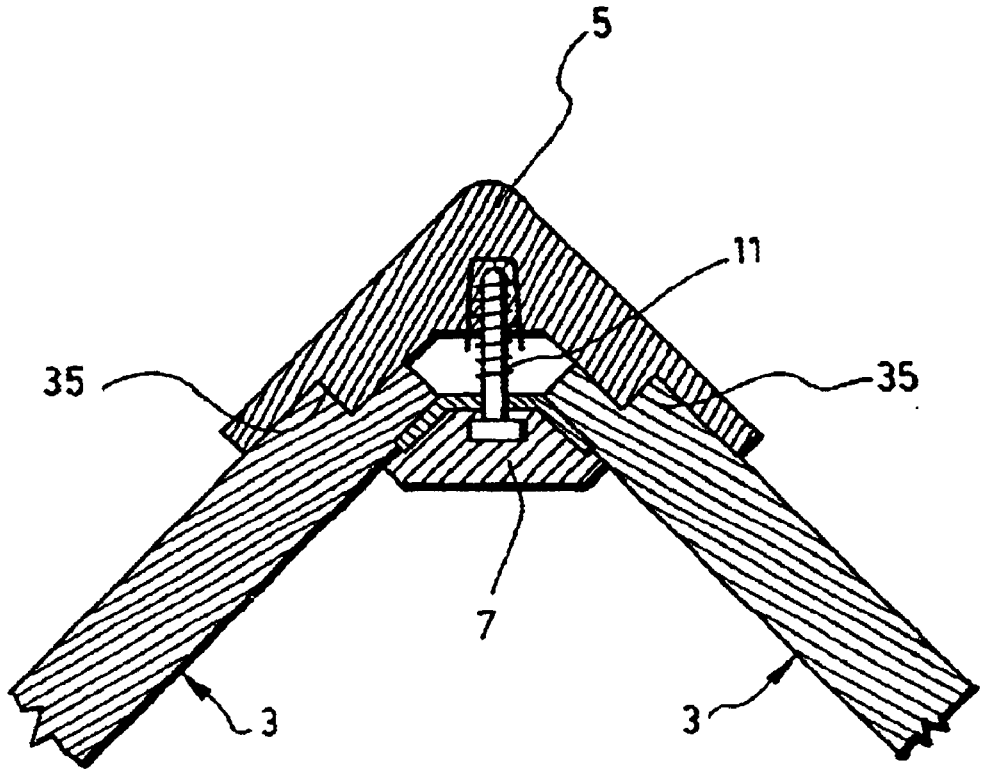
FIG. 24 is a partial top view of the two-part elongated joint sealing the base and panels together in a watertight manner.
Figure 25:
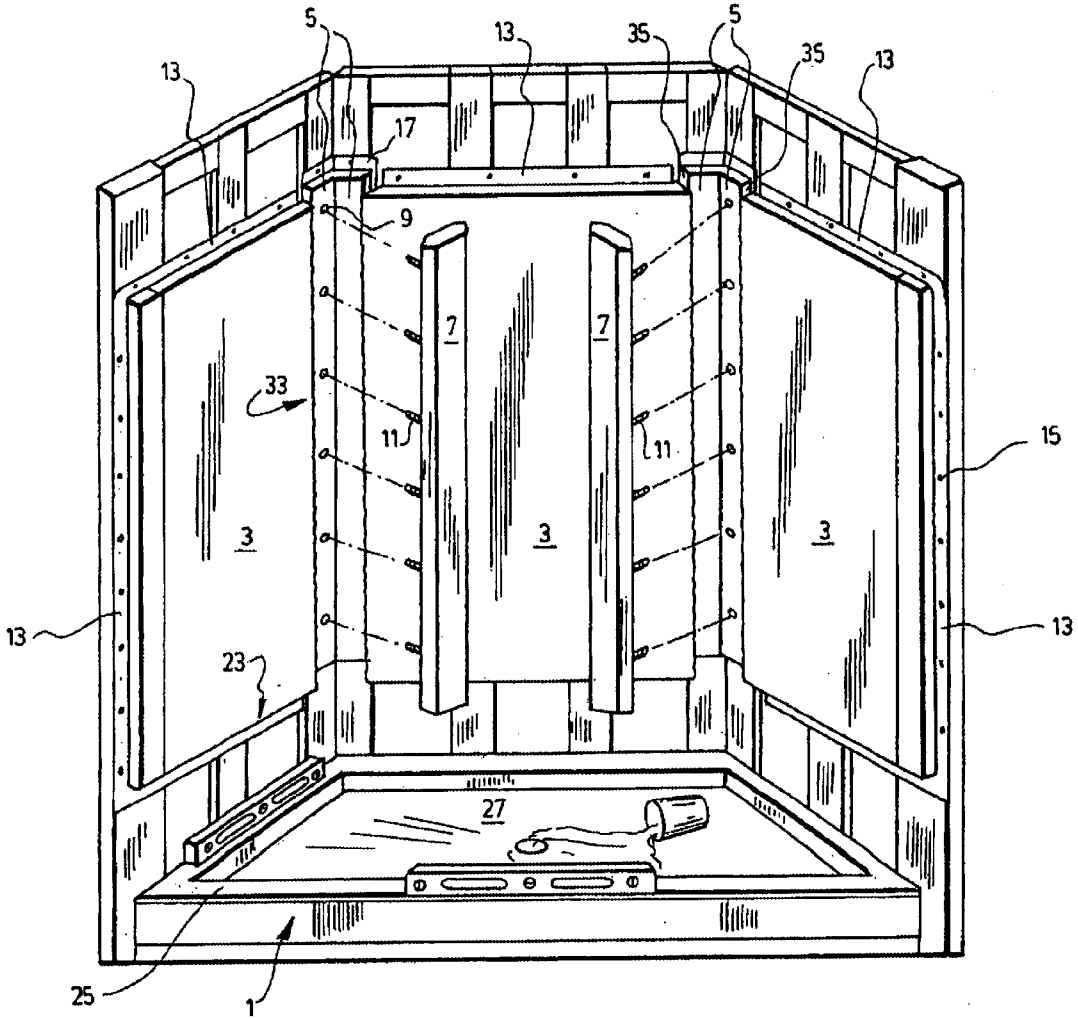
FIG. 25 is a perspective view of a shower structure shown in FIG. 18 in relation to adjacent walls.

The shower structure also comprises a two-part elongated joint including an outer part 5 having, along its length, two distal joint edges 35 (better shown on FIGS. 23 to 25). Each joint edge 35 is adapted for connecting with the inner portion 33 of the second panel edge for fitting the panel 3 and the outer part 5 of the joint together. An inner part 7 is connectable to the outer part 5 for sealing the base 1 and panels 3 together in 4 watertight manner. A securing device secures the outer part 5 of the joint to the adjacent walls. A connecting device connects the two parts 5, 7 of the joint together.

As better shown in FIGS. 4, 5, 9 and 11–15, depending on the user's needs, more than one joint can be used to assembled more than two panels.

Referring now to FIGS. 21 and 23 to 25, preferably, the securing device of the panels 3 comprises 4 flange 13 extending around each of the panel 3. The flange 13 is provided with a plurality of through holes 15 for receiving screws to attach the panel 3 to adjacent wall.

Preferably, the securing device of the outer part 5 of the joint comprises a flange 17 extending around the outer part 5. Instead of extending around the outer part 5 of the joint, the flange 17 can also extend at least along an upper section of the outer part 5. The flange 17 is provided with a plurality of through holes 15 for receiving screws to attach the outer part 5 of the joint to adjacent wall. Mouldings can be used to hide the flanges 13 and 17 from within the shower.

Preferably, the connecting device for connecting the two parts 5, 7 of the joint comprises dowels 11 located at predetermined positions on the inner part 7 and holes 9 located at corresponding positions on the outer part 5. The dowels 11 are inserted within the corresponding holes 9 to fasten the inner part 7 with the outer part 5 of the joint.

An advantage of the shower structure according to the present invention is that it does not require the use of glue, silicone or any other type of sealer usually needed for the installation of a shower structure. However, it is suitable to use a sealer to avoid any possibilities that the panels 3 are not connected in 4 watertight manner to the base 1 to the joint.

Figure 17:
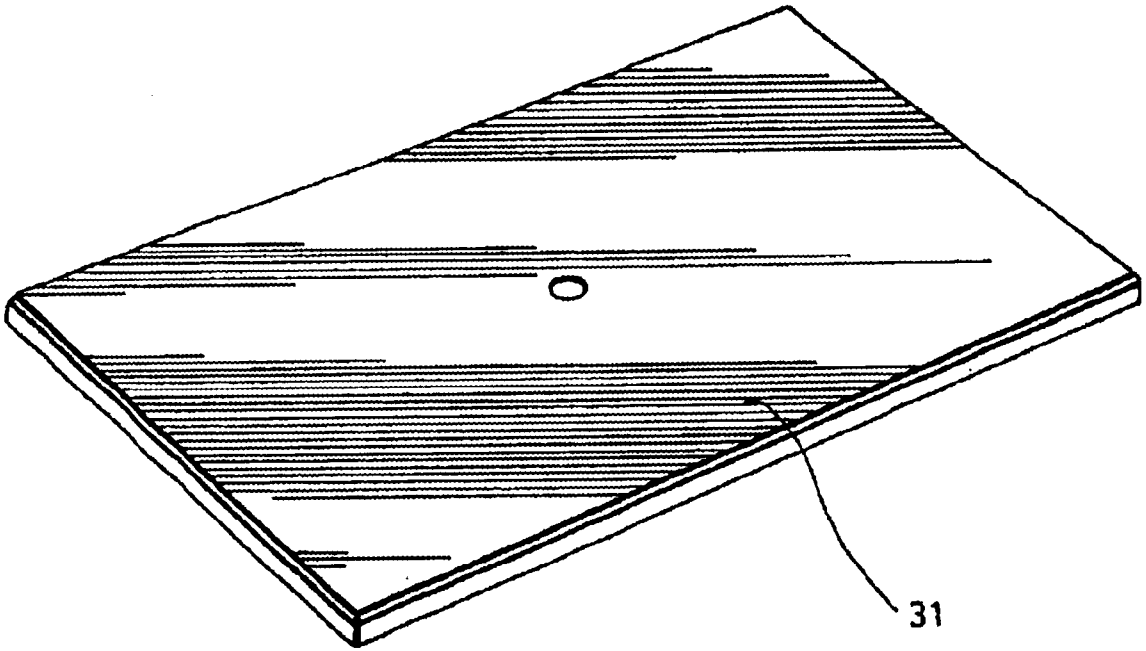
FIG. 17 is a perspective view of a shower structure receiver.
Figure 18:
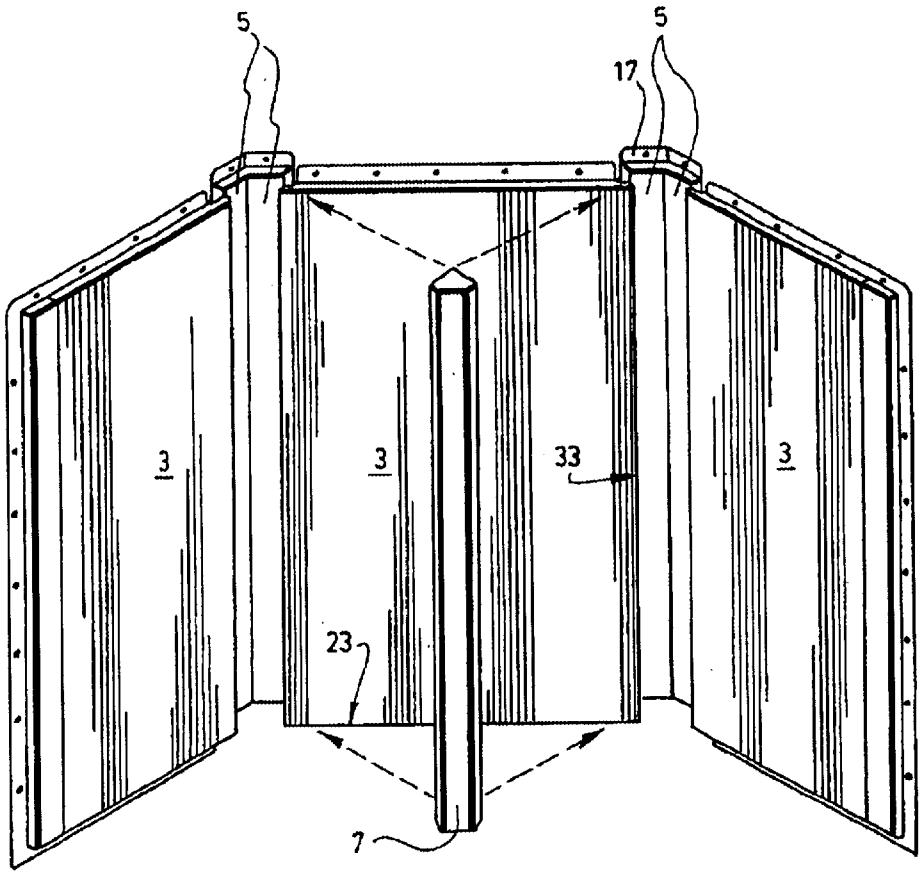
FIG. 18 is a perspective view of a shower structure without the base according to another preferred embodiment of the invention.
Figure 19:
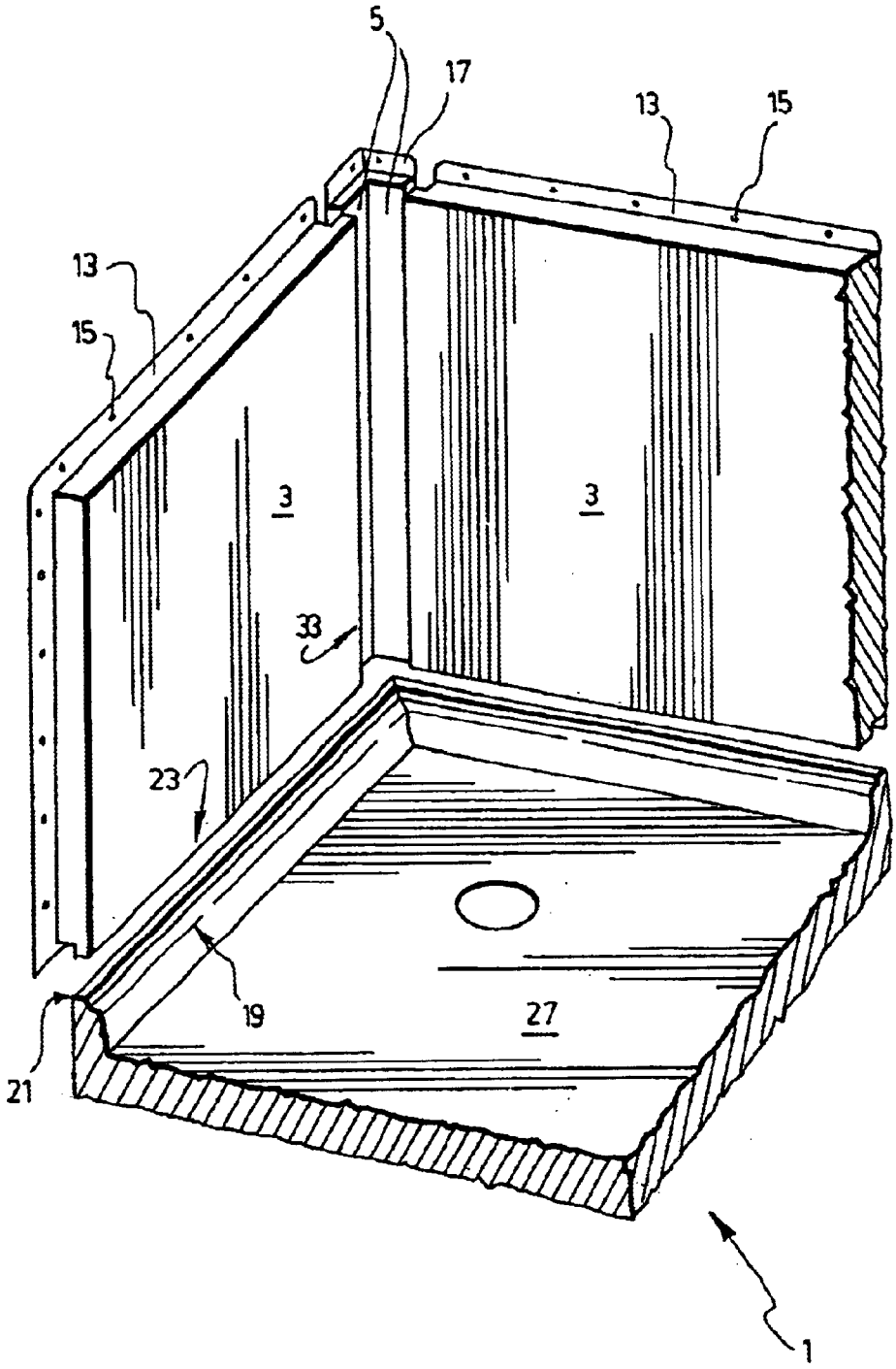
FIG. 19 is a perspective view of a shower structure according to another preferred embodiment of the invention.
Figure 20:
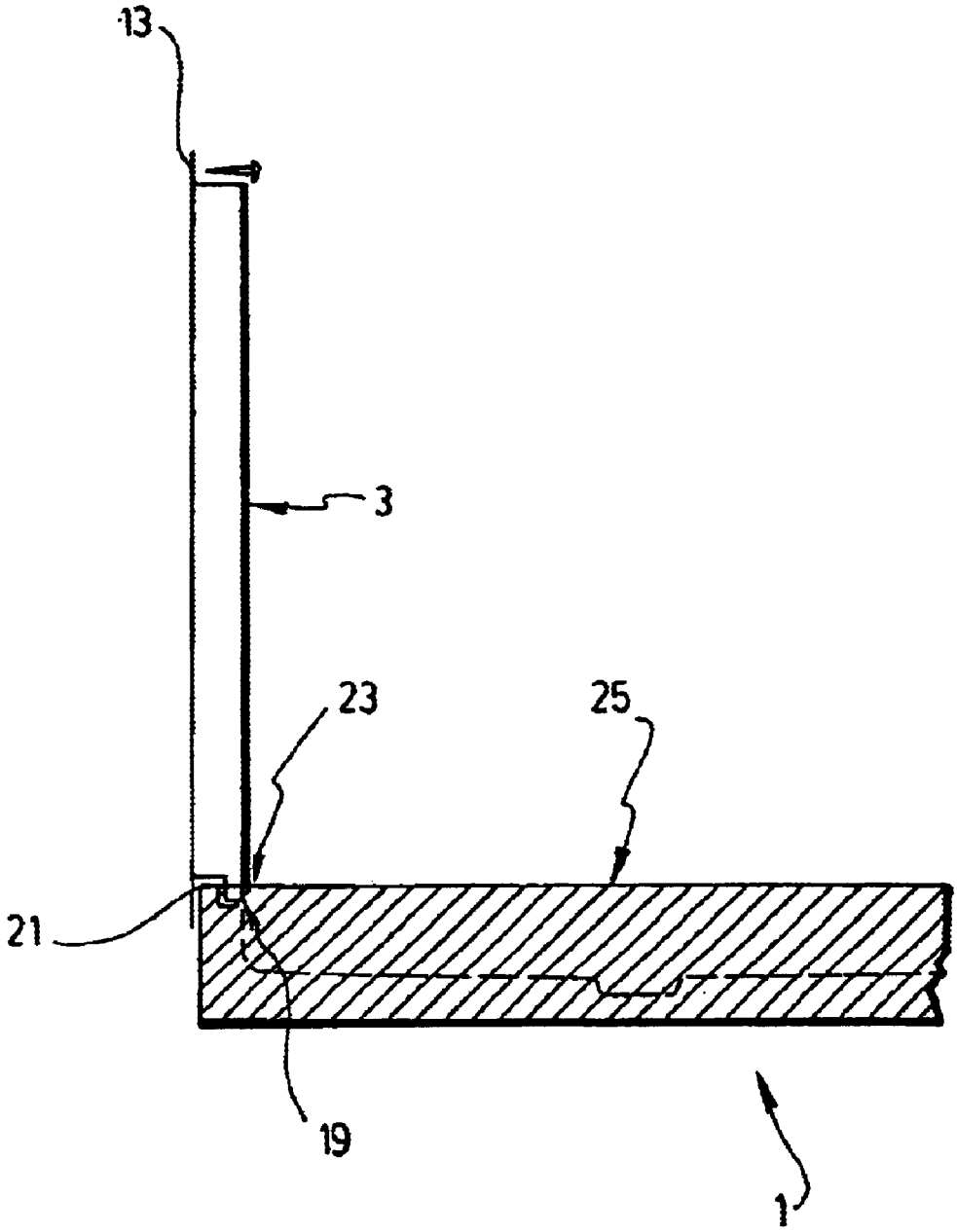
FIG. 20 is a partial side view of a panel connected to the base, according to the present invention.
Figure 21:
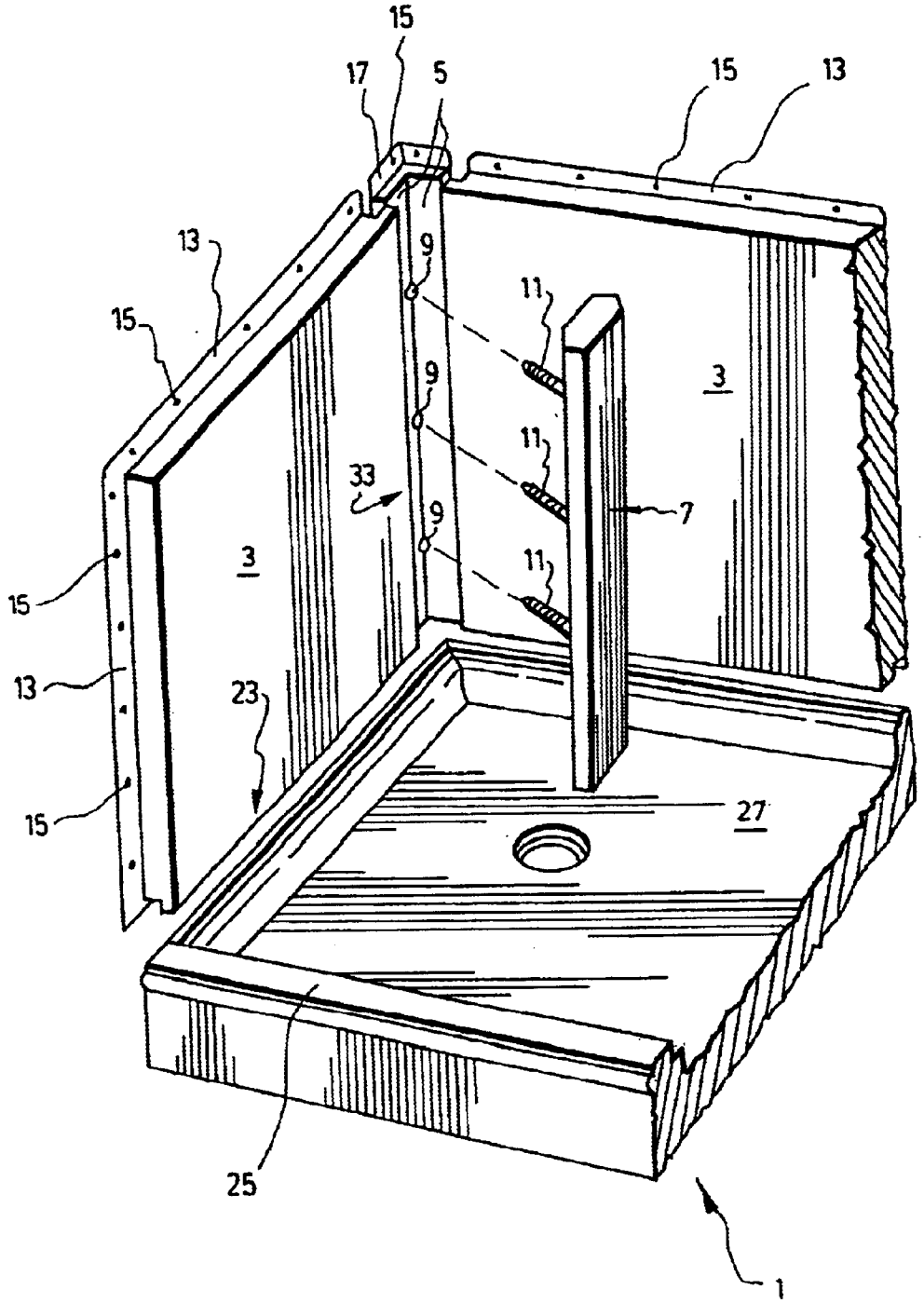
FIG. 21 is a perspective view of a shower structure according to another preferred embodiment of the invention.
Figure 22:
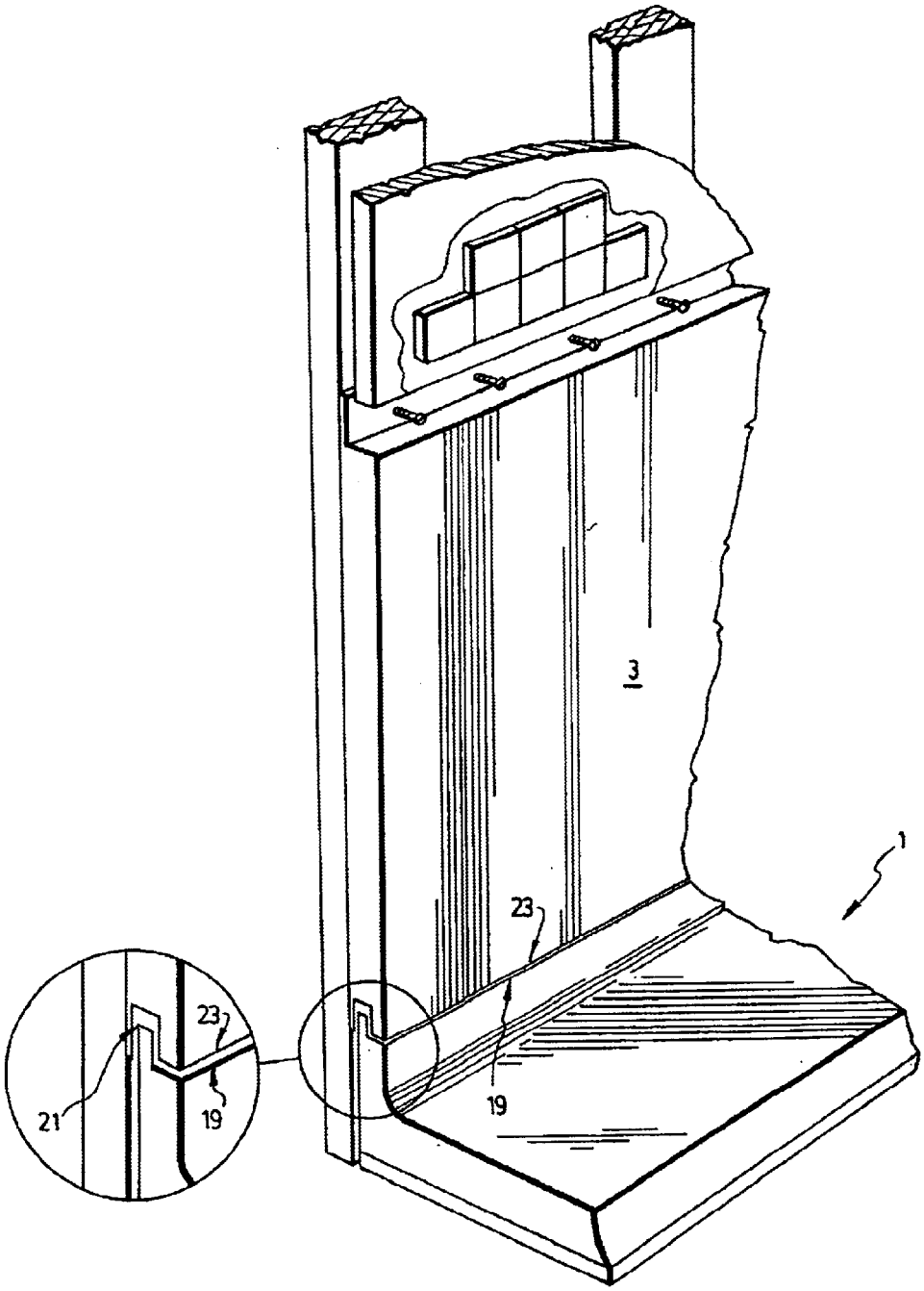
FIG. 22 is a partial perspective view of the panel connected to the base in a watertight manner.

Preferably, the base 1 is fixed on the floor, against a wall. For example, the base 1 is fixed to the floor with cement. As shown in FIG. 17, a shower structure receiver 31 can be fixed to the floor for receiving the base 1.

A typical installation of the base 1 comprises the following steps:

1. Determining the alignment of the drain of the base 1 with respect to the sewer connector.
2. Preparing a mortar bed to place the base 1 of the shower structure.
3. Placing the base 1 of the shower structure on the mortar bed. Leveling the base 1 in all the directions. Leave a space of 3/16" between the base 1 and the wall for installing the panels 3.
4. Verify the sewage of the water by spilling one or two glasses of water inside the base 1.
5. Complete the connection to the sewer connector.

Once the base 1 is fixed, the outer part 5 of the joint is fixed in the corner of two walls with, for example, screws. A typical installation of the outer part 5 of the joint comprises the following steps:

1. Placing the outer part 5 by inserting it's bottom at the back of the base 1.
2. Leveling the outer part 5 on both its vertical edge 35. Fixing the outer part 5 with screws (apply a sealer along the edges).
3. Applying a sealer on the base edge 21 before connecting the panels 3.
4. Fixing the panels. Leveling the panels and fixing the with screws.
5. Verifying the alignment of the panels 3 and the outer part 5 of the joint, readjusting if necessary.
6. Fixing the inner pan 7 of the joint by aligning the dowels 11 to face the holes 9, pressing at maximum capacity (a silicone sealer can be used on the exterior side of the inner part 7).

The first edge of the panel is inserted into the base edge 21 and the second edge of the panel is connected with one of the distal edges 35 of the outer part 5. Once the first edge of the panel 3 is connected with the base 1, the panel 3 is installed by pushing it in a vertical manner, it is adjusted with respect to the edge 35 of the joint and with the base edge 21 before it is vertically leveled and fixed to the wall with screws.

Once the outer part 5 of the joint and the panels 3 are connected together, the inner part 7 of the joint is installed by inserting the dowels 11 within the holes 9 of the outer part 5. The outer and inner parts 5–7 of the joint can also be connected with another fastening device. Preferably, the connecting device is made of a non-corrosive material and is not visible from within the shower structure.

Preferably, the different elements of the shower structure of the present invention are made of solid and non flexible composite materials. The elements are also soundproof.

Figure 26:
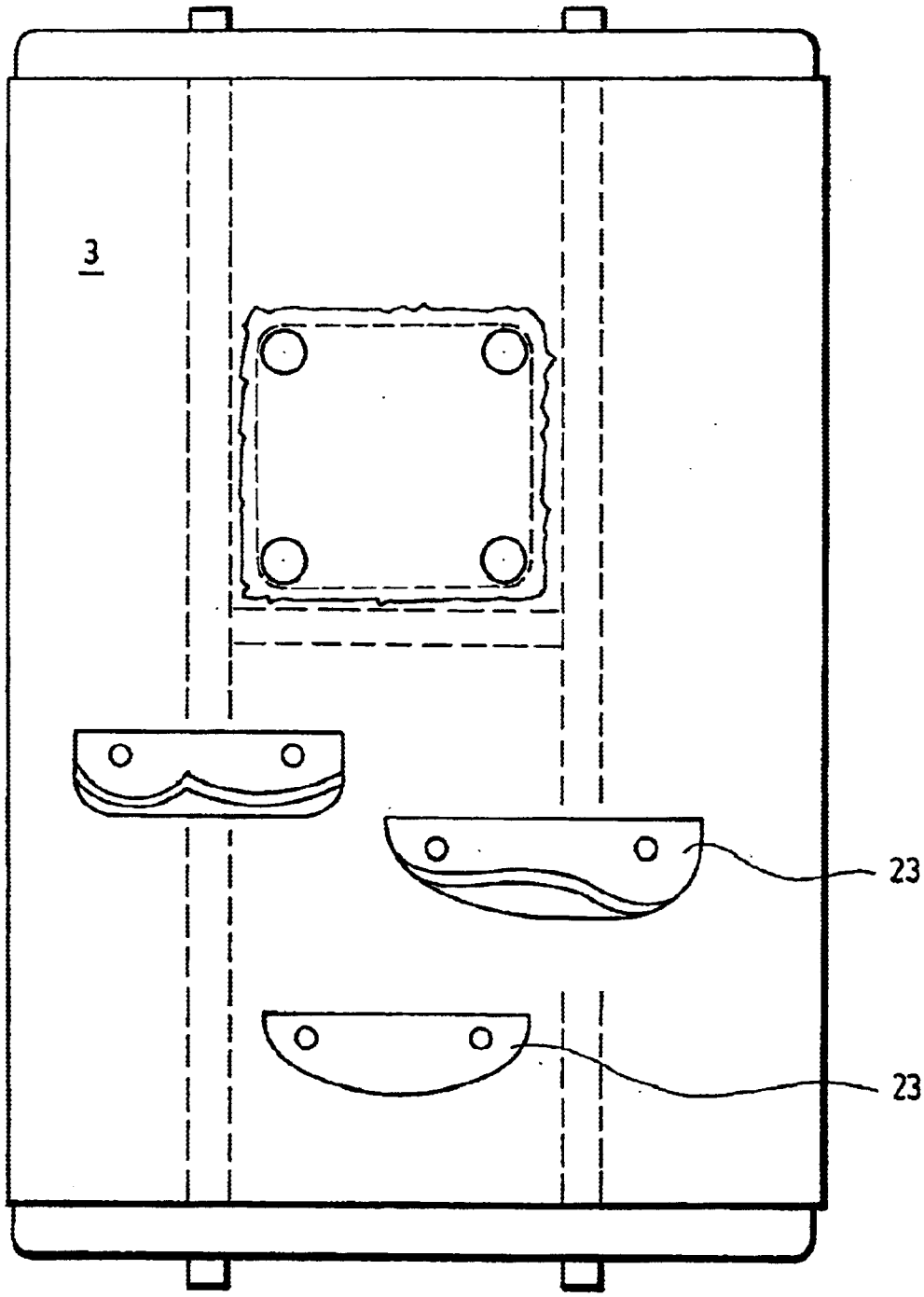
FIG. 26 is a front view of a panel along with other optional elements.
Figure 27:
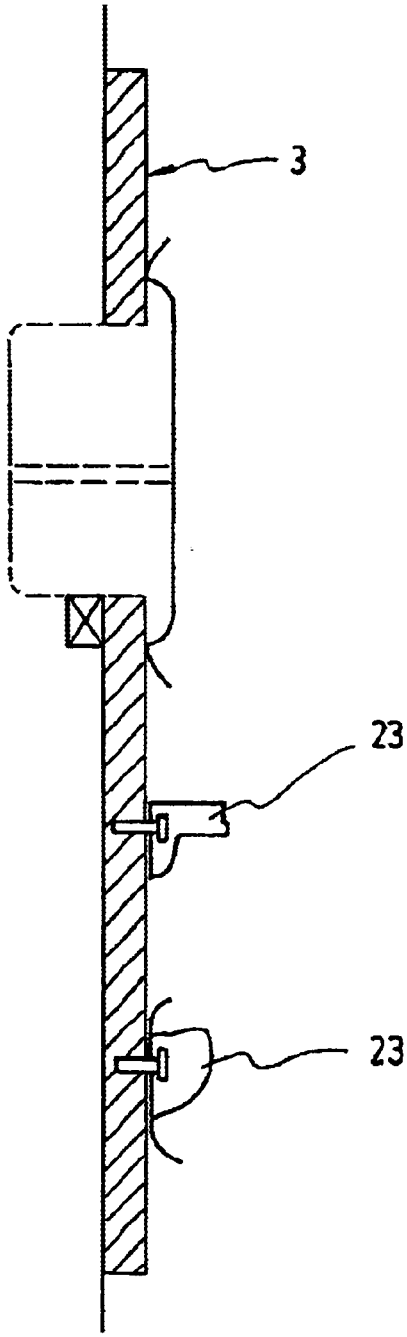
FIG. 27 is a partial side view of the panel shown in FIG. 26.

Referring now to FIGS. 26 and 27, optional elements 23 can be fixed on the panels 3 for storing soap, shampoo or any other products.

The present invention also relates to a method for assembling a shower structure according to the present invention. The method comprises the following steps:

Firstly, a base 1 is fixed to a floor. The base 1 comprises a doorstep 25, a base edge 21 and a bottom 27 surrounded by the base edge 21 and the doorstep 25. Both the base edge 21 and the doorstep 25 are upper than the bottom 27 for containing water. The base edge 21 has an inner portion 19 lower than upper surface of the doorstep 25.

Secondly, an outer part 5 of a joint is fixed in relation to the base 1 to at least one adjacent wall. The outer part 5 has, along its length, two distal joint edges 35.

Thirdly, the outer part 5 of the joint is secured to adjacent walls.

Fourthly, two panels 3 arm connected to the base 1 on both sides of the joint. Each of the panels 3 has a first panel edge provided with an inner portion 23 for contact with the inner portion 19 of the base edge 21 for fitting the base 1 and the panel 3 in a watertight manner. A second panel edge is also provided with an inner portion 33. Each joint edge 35 is adapted for connecting with the inner portion 33 of the corresponding second panel edge for fitting the corresponding panel 3 and the outer part 5 of the joint together.

Fifthly, the panels 3 are secured to adjacent walls.

Finally, an inner part 7 of the joint is connected to the outer part 5 of the joint for sealing the base 1 and panels 3 together in a watertight manner.

Although she present invention has been explained hereinabove by way of preferred embodiments thereof, it should be pointed out that any modifications to the preferred embodiments within the scope of the appended claims is not deemed to alter or change the nature and scope of the present invention.

What is claimed is:

1. A shower structure, comprising:

a base comprising a doorstep, a base edge and a bottom surrounded by the base edge and the doorstep, both the base edge and the doorstep being upper than the bottom for containing water, said base edge having an inner portion lower than upper surface of the doorstep;

at least two panels, each having a first panel edge provided with an inner portion for contact with the inner portion of the base edge for fitting the base and the panel in a watertight manner, a second panel edge also provided with an inner portion, and securing means for securing the panels to adjacent walls; and a two-part elongated joint including an outer part having, along its length, two distal joint edges, each joint edge being adapted for connection to the inner portion of the second panel edge for fitting the panel and the outer part or the joint together, an inner part connectable to the outer part for sealing the base and panels together in a watertight manner, securing means for securing the outer part of the joint to said adjacent walls, and connecting means for connecting the two parts of the joint together.

2. A shower structure according to claim 1, wherein the securing means of said panels comprises a flange extending around each of the panel, the flange being provided with a plurality of through holes for receiving screws to attach the panel to said adjacent wall.

3. A shower structure according to claim 1, wherein the securing means of said outer part of the joint comprises a flange extending around the outer part, the flange being provided with a plurality of through holes for receiving screws to attach the outer part to said adjacent wall.

4. A shower structure according to claim 1, wherein the connecting means of the joint comprise dowels located at predetermined positions on the inner part and holes located at corresponding positions on the outer part, the dowels being inserted within the corresponding holes to fasten the inner part with the outer part of the joint.

5. A method for assembling a shower structure, comprising the following steps:

fixing a base to a floor, the base comprising a doorstep, a base edge and a bottom surrounded by the base edge and the doorstep, both the base edge and the doorstep being upper than the bottom for containing water, said bas edge having an inner portion lower than upper surface of the doorstep;

fixing an outer part of a joint in relation to the base to at least one adjacent wall, the outer part having, along its length, two distal joint edges;

securing the outer part of the joint to said adjacent walls;

connecting two panels to the base on both sides of the joint, each of the panels having a first panel edge provided with an inner portion for contact with the inner portion of the base edge for fitting the base and the panel in a watertight manner, a second panel edge also provided with an inner portion, each joint edge being adapted for connecting with the inner portion of the corresponding second panel edge for fitting the corresponding panel and the outer part of die joint together;

securing the panels to adjacent walls; and connecting an inner pant of the joint to the outer pert of the joint for sealing the base and panels together in a watertight manner.

* * * * *